US007975413B1

(12) United States Patent
Baryla, Sr.

(10) Patent No.: US 7,975,413 B1
(45) Date of Patent: Jul. 12, 2011

(54) SIGNAGE SYSTEM

(76) Inventor: Stanley J. Baryla, Sr., Midland, MI (US)

( * ) Notice: Subject to any disclaimer, the term of this patent is extended or adjusted under 35 U.S.C. 154(b) by 947 days.

(21) Appl. No.: 11/370,406

(22) Filed: Mar. 8, 2006

Related U.S. Application Data

(60) Provisional application No. 60/660,140, filed on Mar. 9, 2005, provisional application No. 60/677,239, filed on May 3, 2005.

(51) Int. Cl.
*G09F 7/00* (2006.01)

(52) U.S. Cl. ..... 40/611.08; 40/721; 40/611.06

(58) Field of Classification Search ..... 40/618, 40/611.06, 611.08, 721, 734, 624
See application file for complete search history.

(56) References Cited

U.S. PATENT DOCUMENTS

| | | | | |
|---|---|---|---|---|
| 3,230,652 | A * | 1/1966 | McNair | 40/622 |
| 3,930,327 | A * | 1/1976 | Friedman | 40/620 |
| 4,138,787 | A * | 2/1979 | Sarkisian et al. | 40/618 |
| 4,377,915 | A * | 3/1983 | Zossimas et al. | 40/785 |
| 4,753,026 | A * | 6/1988 | Woodman et al. | 40/584 |
| 4,773,174 | A * | 9/1988 | Boeniger et al. | 40/792 |
| 5,038,506 | A * | 8/1991 | Liljeqvist et al. | 40/618 |
| 5,357,701 | A * | 10/1994 | Grate | 40/618 |
| 5,458,307 | A * | 10/1995 | Gebka | 248/205.3 |
| 5,737,888 | A * | 4/1998 | Shimek et al. | 52/312 |
| 6,460,279 | B1 * | 10/2002 | Stanley et al. | 40/595 |
| 6,530,167 | B1 * | 3/2003 | Schuetz et al. | 40/611.08 |

* cited by examiner

*Primary Examiner* — Joanne Silbermann
*Assistant Examiner* — Christopher E Veraa
(74) *Attorney, Agent, or Firm* — Christopher John Rudy

(57) ABSTRACT

Signage member can be installed for display in sign support member mounted on a wall. Multiple sign support members can be abutted with one or more fastener(s). Such fastener(s) can have a tall nut and tall screw about one end and a threaded hole and short screw about another. One or more signage member(s) may be stored behind the displayed signage member.

14 Claims, 2 Drawing Sheets

SIGNAGE SYSTEM

CROSS-REFERENCE CLAIMS OF PRIORITY

This claims benefits under 35 USC 119(e) of provisional patent application No. 60/660,140 filed on Mar. 9, 2005 A.D., and 60/677,239 filed on May 3, 2005 A.D. The specifications of those applications are incorporated herein by reference in their entireties, which thus includes their drawings.

BACKGROUND TO THE INVENTION

I. Field and Purview

The invention concerns a signage system having a sign support member in which a signage member can be installed for display. Simple, ready attachment and removal of the signage member and storage of other signage member(s) not displayed can be provided. Also of concern can be a fastener with a substantially flat base having generally parallel sides and opposing ends, a tall nut and a threaded hole provided about separate ends, for a tall nut and a short nut, respectively. The fastener can be, for example, in a form of an L-shape or a bar, which forms are especially useful in the signage system.

II. Art and Problems

Among popular types of signage is the banner. Banners are relatively inexpensive and portable. Drawbacks, however, include their perceived "cheapness," a sometimes difficult, cumbersome installation, typically through ropes, lower levels of attachment security and at times visibility owing to movement of the banners in the breeze, and so forth.

A FULL DISCLOSURE OF THE INVENTION

I. Objects

It is an object of the present invention to improve the art.

It is an object to provide a more stable signage platform having advantages of banners, at least in a relative sense, but without one or more of their drawbacks.

It is an object to provide signage, which can be profitably priced like or in competition with a banner, but which has a more professional and attractive appearance than a banner.

It is an object to allow unskilled labor to change messages.

It is an object to allow this with special fasteners.

It is an object to provide alternatives to the art.

Other objects of the invention may exist.

II. Provisions

In general, the present invention provides a signage system comprising a sign support member in which a signage member can be installed for display. The members may be found in combination. Also provided is a fastener with a substantially flat base having generally parallel sides and opposing ends, a tall nut and a threaded hole provided about separate ends, for tall and short nuts, respectively, which may be employed in the signage system.

The invention is useful in advertising and fastening.

Significantly, by the invention, at least one of the noted objects is satisfied, if not completely, at least in part. The art is improved in kind. The sign support member can be more permanently installed, with the signage member easily installed, removed, reversed, replaced and/or stored. Thus, simple, ready attachment and removal of the signage member, and storage of another signage member not on display, can be provided. In addition, the system can cover unsightly building defects, and it can be profitably priced like or in competition with a banner but has a more professional and attractive appearance. It can be attached to nearly any solid surface, and can be attention grabbing. With the system of the invention, unskilled labor can change messages. A self-contained, professional signage system, which can meet the marketing needs of many businesses, which may include small, medium and large ones, is thus provided.

Wrestling with banner installation, only to have the banner wrinkled or displaced by the wind, is avoided. Avoided, too, are sloppy banner looks, less visible message display, and so forth.

Also minimized or avoided can be lost screws in the field.

Numerous further advantages attend the invention.

The drawings form part of the specification hereof. With respect to the drawings, which are not necessarily drawn to scale and in which dimensions are generally given in inches, which may be considered to be approximate, the following is briefly noted:

The invention can be further understood by the present detail including that set forth below, which may be read in light of the drawings. The same is to be understood in an illustrative and not necessarily limiting sense.

As noted above, in general, the signage system comprises a sign support member in which a signage member can be installed for display. Further, the sign support member advantageously includes at least one groove to receive a portion of the signage member for display. Beneficially, the signage member is a rigid panel, which may be lightweight, and have messages on two sides.

With reference to the drawings, signage system 100 includes sign support member 10. It also may include signage member 20.

Any suitable materials may be employed to make the members 10, 20. For instance, the sign support member 10 may be made of a suitable metal, plastic, wood or composite, for example, of extruded aluminum, say, aluminum 6061-T6, which may be anodized in color, say, an architectural brown, a color that may compliment many decors, to provide an anodized architectural aluminum frame as the member 10. The signage member 20 may be made of a suitable plastic, metal, wood or composite, for example, a polyolefin type plastic, say, COROPLAST polypropylene or polyethylene corrugated panel, on which signage indicia, or, as it may be known in the art, substrate, may be provided, say, on one side or on both sides of the panel.

Figure 1:
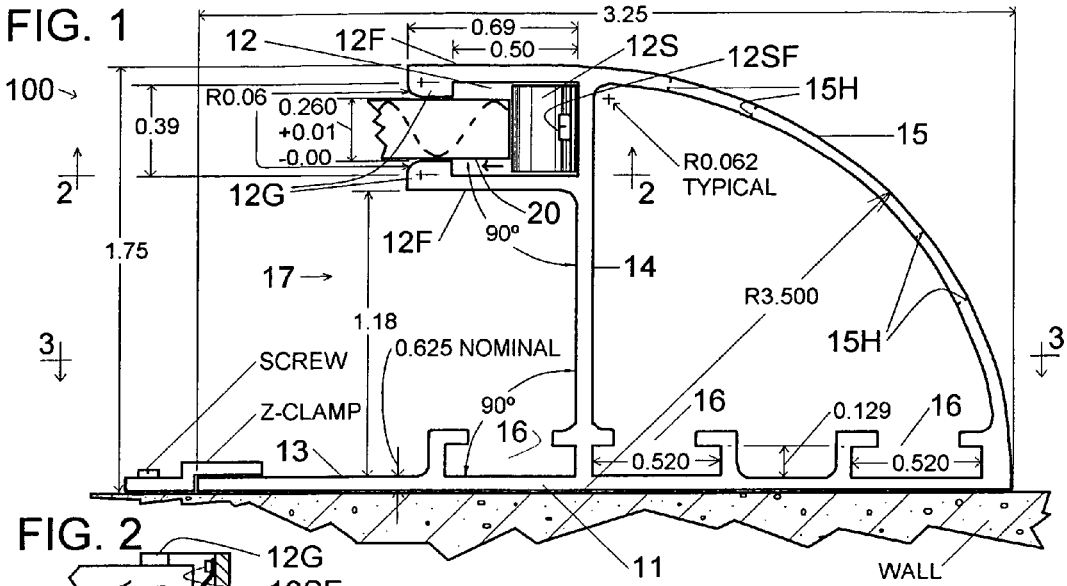
FIG. 1 is an "end" plan view of a sign support member of the present invention, with a signage member installed.
Figure 2:
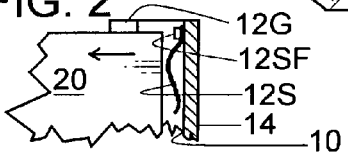
FIG. 2 is a cross-sectional plan view of the invention, which shows spring biasing in a signage member receiving groove, taken along 2-2 in FIG. 1.
Figure 3:
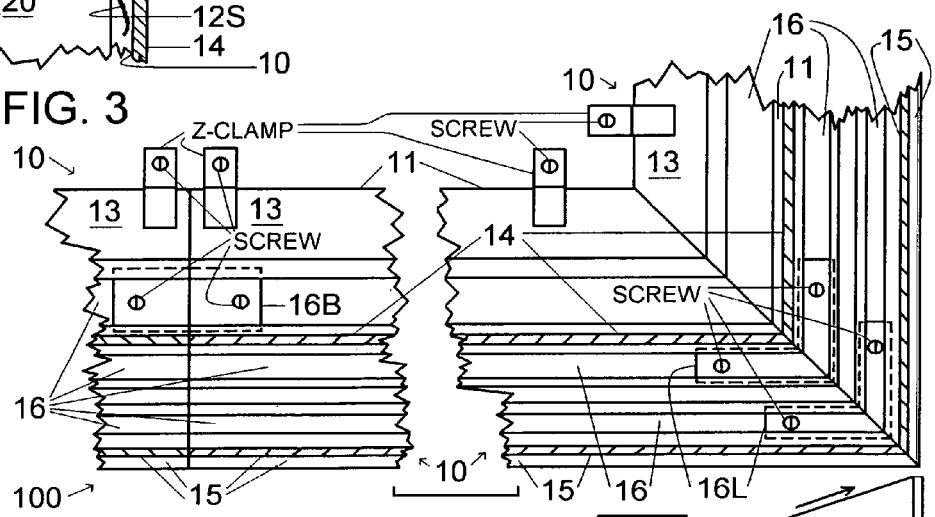
FIG. 3 is a cross-sectional plan view of the invention having a plurality of sign support members as of FIG. 1, taken along 3-3 of FIG. 1, assembled end to end and at a mitered corner.
Figure 4:
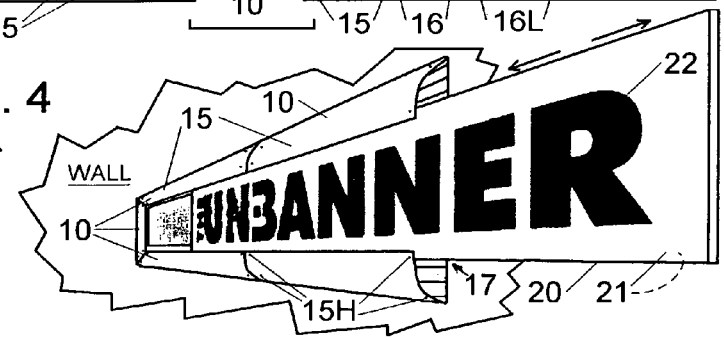
FIG. 4 is a front perspective plan view of a signage system hereof, which includes members as of FIGS. 1-3, and signage member being installed in three portions of a frame with a fourth portion, an "end cap," not yet installed, hence not illustrated.
Figure 5:
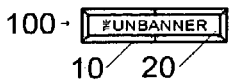
FIG. 5 is a front plan view of the system of FIG. 4 having all four portions of the sign support members and the signage member installed.

The sign support member 10, which may be provided in any suitable length, say, in eight-foot sections that may be joined for longer lengths or cut for shorter, includes support body 11 and groove 12 for receiving the signage member 20. The groove 12 may include side fingers 12F, gate stops 12G, which may help hold or align stainless or spring steel spring 12S in place along with spring fastener 12SF such as a screw. Preferably, a series of the springs 12S are provided, each of which is biased outwardly, spaced along lengths of the groove 12 for engaging the signage member 20 on display along its outer border. Engagement with the spring 12S advantageously can be generally light. Base 13 may be mounted against a building wall, for example, through Z-clamps that are loosely mounted to the base 13 with a suitable auxiliary fastener such as a screw so as to allow for expansion. Preferably, the groove 12 is oriented substantially parallel to the base 13 for a corresponding orientation with the wall on which the base 13 is mounted, and is formed on inner strut 14 and further supported with outer strut 15, which for strength and beauty may be radially shaped, and which may be provided with hole(s) 15H for insertion of an installation tool. Inverse-T channels 16 provide for joining of adjacent members 10, for example, through flat ⅛-inch thick by ½-inch wide aluminum bar stock 16B under the groove 12 to join two members 10 abutting each other to extend overall length, or through ⅛-inch thick by ½-inch wide aluminum L-brackets 16L under the radial strut 15 to join two members 10 at a mitered corner. The stock 16B or brackets 16L may be secured with suitable fasteners, say, screws, with the assistance of the installation tool; for example, the screws may be of the Allen type, and the installation tool an Allen wrench, or preferably, a ball-headed Allen wrench, which allows for more forgiveness in the approach and connection angle with the screw, as is known in the art. Signage member stowage volume 17 may hold several signage members 20 not on display, for example, three or four ¼-inch thick panels, and is generally bounded by the groove 12, base 13, and inner strut 14. See generally, FIGS. 1-5.

Figure 6:
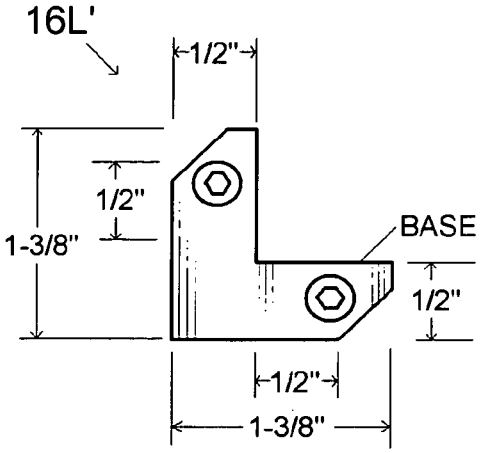
FIG. 6 is a top plan view of a particularly advantageous corner fastening bracket of the invention.
Figure 7:
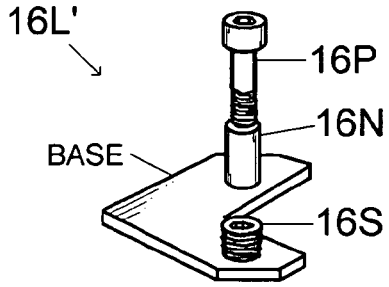
FIG. 7 is an isometric view of the bracket of FIG. 6.
Figure 8:
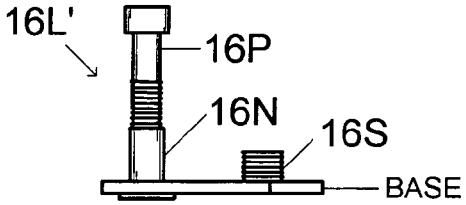
FIG. 8 is an elevational view of the bracket of FIG. 6.
Figure 9:
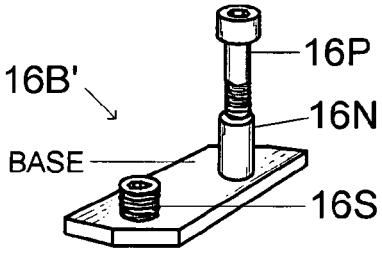
FIG. 9 is a perspective view of a particularly advantageous lengthwise fastening bracket of the invention.
Figure 10:
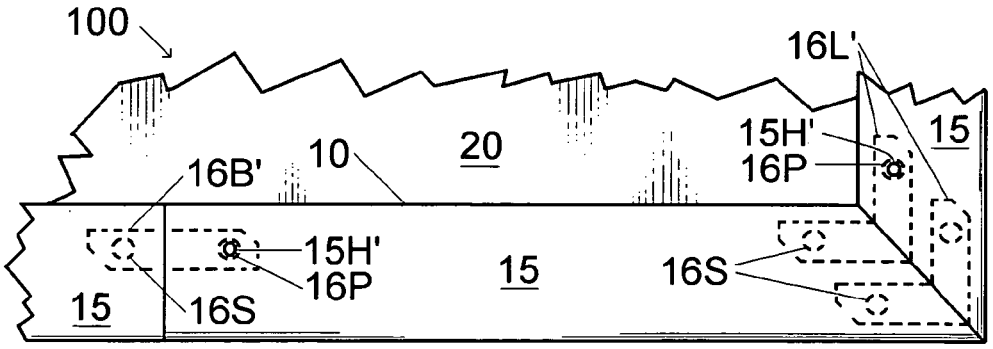
FIG. 10 is a plan view of a signage system of the invention, which includes employment of the brackets as of FIGS. 6 and 9.

A beneficial modification of the sign support member 10 as otherwise described in detail above but, say, having hole 15H', which can be provided as a solitary hole on one end of the member 10 only, can include employment of one or more of brackets 16B' or especially 16L' (corner cleat), which, for example, may be of steel, each of which can include in one area of a base of the bracket 16B', 16L', in a raised nut 16N, for example, an 8-32 rivet nut, which is attached to the base; a more protruding screw 16P, for example, an 8-32×⅝-inch socket head cap screw, which is threaded into the raised nut 16N; and, threaded into another area of the base itself, a shorter screw 16S, for example, a ¼-20 socket set screw. The corner cleat 16L' can be made in mirror-image, i.e., left versus right hand, forms. The shorter screw 16S can be employed to affix one or more brackets 16B', 16L' to a first sign support member 10, say, by first placing it in a channel such as the aforementioned channel 16, and tightening it to secure it, say, away from the installation site; preferably then a second member 10 is attached to the first member 10 through insertion of the free end of the bracket 16B', 16L', and the more elongate screw 16P is fastened with a suitable tool, which may be inserted through the hole 15H'. Adequate support for a corner junction can be provided with two brackets 16L', both of which are secured to the corner cut of the member 10 with shorter screws 16S, but only one of which, for example, an inside bracket 16L' having its elongate screw 16P tightened against the second member 10. The longer screw 16P, which has more threads, is more forgiving in the field, not disengaging from the longer nut 16N so readily as would a shorter screw that may more readily disengage in the field and get lost. A plug (not illustrated) may be provided to fill the hole 15H' (or 15H). Accordingly, fasteners themselves can have substantially flat bases with generally parallel sides and opposing ends; each can have a tall nut and a threaded hole provided about separate ends, for tall and short nuts, respectively. Compare, FIGS. 6-10.

The signage member 20, for example, ¼-inch or 6-millimeter thick durable lightweight panel, which, again, may have a corrugated interior, has face 21, which may contain indicia or substrate 22. The indicia or substrate 22 may be provided on opposing faces 21 for greater economy and ease of changing and storing displays. Note, FIGS. 1, 4, 5 and 10.

As with the disclosure of the present written description, linear dimensions, radii and angles provided in the drawings may be considered to be precise or approximate.

The system 100, with its features, component parts, and so forth, has many further advantages and benefits.

CONCLUSION TO THE INVENTION

The present invention is thus provided. Various feature(s), part(s), step(s), subcombination(s) and/or combination(s) can be employed with or without reference to other feature(s), part(s), step(s), subcombination(s) and/or combination(s) in the practice of the invention, and numerous adaptations and modifications can be effected within its spirit, the literal claim scope of which is particularly pointed out as follows:

I claim:

1. A signage system comprising a sign support member in which a rigid panel signage member can be installed for display in lieu of a banner, wherein the sign support member is provided and assembled as a plurality of elongate sections, which include:

a support body having an elongate base having a first side and outer boundaries, to which base is connected inner and outer struts:

with the inner strut projecting in a first direction from an inner portion of the first side of the base, which inner portion is between the outer boundaries of the base, and running elongately lengthwise in a substantially same second direction as the base, and with the outer strut initially projecting generally in the first direction from an outer portion of the first side of the base, and running elongately lengthwise in the substantially same second direction as the base and inner strut, and connecting with a distal portion of the inner strut away from the base to further support the inner strut and to define a volume bounded by the inner and outer struts; and substantially parallel to the second direction of the base being also included:

a groove including side fingers substantially away from the base with respect to the first direction and formed on the inner strut and supported with the outer strut, which groove can receive the signage member, and at least one inverse-T channel to provide for joining of adjacent elongate sections;

wherein:

in the groove of at least one elongate section is placed at least one outwardly biased spring that can engage the signage member along its outer border when the signage member is on display;

the sign support member has opposing support bodies with elongate bases with opposing elongate grooves including side fingers, which grooves open facing each other such that the signage member can be received in the opposing, facing grooves and span the opposing elongate bases; and the signage system provides for attachment and removal of the signage member, and provides for storage behind a rigid panel signage member on display of at least one other rigid panel signage member not on display.

2. The signage system of claim 1, which is assembled to be in a generally rectangular shape, and L-brackets are employed to help fasten adjacent elongate members through inverse-T channels at ends of the elongate members, which have mitered corners.

3. The signage system of claim 2, wherein:

the outer strut of at least one of the adjacent elongate members includes at least one hole by said end;

the L-brackets have a substantially flat base of one and only one piece of material with at least two generally parallel sides, and generally opposing first and second ends, and provided with the base of the L-bracket are:

a tall nut connected to and projecting substantially up from the base of the L-bracket and having an extended set of threads provided in the tall nut about the first end of the base of the L-bracket; and a threaded hole provided in the base about the second end of the base; and a long screw, which is threaded into the tall nut of the L-bracket, and a short screw, which is threaded into the threaded hole in the base of the L-bracket, are provided.

4. The signage system of claim 1, which includes elongate sections that abut to extend a linear dimension of the signage system, and bar stock is employed to help fasten adjacent elongate members at ends through inverse-T channels of the elongate members.

5. The signage system of claim 4, wherein:

the outer strut of at least one of the adjacent elongate members includes at least one hole by said end;

the L-brackets have a substantially flat base of one and only one piece of material with at least two generally parallel sides, and generally opposing first and second ends, and provided with the base of the L-bracket are:

a tall nut connected to and projecting substantially up from the base of the L-bracket and having an extended set of threads provided in the tall nut about the first end of the base of the L-bracket; and a threaded hole provided in the base about the second end of the base; and a long screw, which is threaded into the tall nut of the L-bracket, and a short screw, which is threaded into the threaded hole in the base of the L-bracket, are provided.

6. In combination, the signage system of claim 1; and a wall to which the signage system is mounted.

7. The signage system of claim 1, wherein the outer strut is generally radial, and has at least one hole by an end whereof.

8. The signage system of claim 1, which includes the signage member.

9. A signage system comprising a sign support member in which a rigid signage member can be installed for display in lieu of a banner, wherein the sign support member is provided and assembled as a plurality of elongate sections, each of which include a support body having an elongate base having a top and a substantially flat bottom, to which base is connected a strut projecting from the top of the base in a first direction and running lengthwise in a substantially same second direction as the base; and, connected to a portion of the strut substantially away from the base in the first direction, side fingers that are substantially parallel in the second direction with the bottom of the base and define sides of a groove running substantially parallel to the bottom of the base, which groove can receive the signage member; and, in the groove, a series of springs, each of which is outwardly biased in relation to the strut in a direction substantially parallel with the bottom of the base; with such grooves opening so as to oppose an opposing groove in another elongate section so as to engage the signage member along its outer border when the signage member is on display and wherein the signage system provides for storage behind a rigid panel signage member on display of at least one other rigid panel signage member not on display.

10. The signage system of claim 9, wherein the sign support member sections have the base, strut and fingers monolithically made.

11. The signage system of claim 10, wherein at least two of the sign support member sections, which oppose and run substantially parallel with each other, are about eight feet in length.

12. The signage system of claim 10, which includes the signage member.

13. A signage system comprising a sign support member in which a rigid signage member can be installed for display in lieu of a banner, wherein the sign support member is provided and assembled as a plurality of elongate sections, each of which include a support body having an elongate base having a top and a substantially flat bottom, to which base is connected a strut projecting from the top of the base in a first direction and running lengthwise in a substantially same second direction as the base; and, connected to a portion of the strut substantially away from the base in the first direction, side fingers that are substantially parallel in the second direction with the bottom of the base and define sides of a groove running substantially parallel to the bottom of the base, which groove can receive the signage member, with such grooves opening so as to oppose an opposing groove in another elongate section so as to engage the signage member along its outer border when the signage member is on display; and wherein the signage system provides for storage behind a rigid panel signage member on display of at least one other rigid panel signage member not on display.

14. The signage system of claim 13, which includes the signage member.

* * * * *